US005489913A

United States Patent [19]

Raguenet et al.

[11] Patent Number: 5,489,913

[45] Date of Patent: Feb. 6, 1996

[54] MINIATURIZED RADIO ANTENNA ELEMENT

[75] Inventors: Gérard Raguenet, Eaunes; Michel Gomez-Henry, L'Union, both of France

[73] Assignee: Alcatel Espace, Courbevoie, France

[21] Appl. No.: 309,626

[22] Filed: Sep. 21, 1994

Related U.S. Application Data

[63] Continuation of Ser. No. 925,181, Aug. 6, 1992, abandoned.

[30] Foreign Application Priority Data

Aug. 7, 1991 [FR] France ..... 91 10066

[51] Int. Cl.[6] ..... H01Q 13/10; H01Q 13/20

[52] U.S. Cl. ..... 343/767; 343/770

[58] Field of Search ..... 343/767, 770, 343/771, 746; H01Q 13/10, 13/20

[56] References Cited

U.S. PATENT DOCUMENTS

| | | | |
|---|---|---|---|
| 2,832,955 | 4/1958 | Jasik | 343/770 |
| 2,971,193 | 2/1961 | Suikola | 343/770 |
| 3,577,196 | 5/1971 | Pereda | 343/770 |
| 3,713,165 | 1/1973 | Lagerlof et al. | 343/771 |
| 4,150,383 | 4/1979 | Andersson et al. | 343/768 |
| 4,445,122 | 4/1984 | Pues | 343/700 MS |
| 4,590,478 | 5/1986 | Powers et al. | 343/770 |
| 4,803,494 | 2/1989 | Norris et al. | 343/770 |
| 4,916,457 | 4/1990 | Foy et al. | 343/770 |
| 5,068,670 | 11/1991 | Maoz | 343/767 |
| 5,119,107 | 6/1992 | Wildey et al. | 343/770 |

FOREIGN PATENT DOCUMENTS

| | | | |
|---|---|---|---|
| 0295003 | 12/1988 | European Pat. Off. . | |
| 55-128903 | 10/1980 | Japan | 343/770 |
| 58-30209 | 2/1983 | Japan | 343/767 |
| 655045 | 7/1951 | United Kingdom | 343/767 |
| 2074792 | 11/1981 | United Kingdom | 343/767 |

OTHER PUBLICATIONS

King et al, "A Shallow Ridged–Cavity Crossed Slot Antenna for the 240 to 400 MHZ Frequency Range", IEEE Trans. Antenna Propagat, vo. 36, Mar. 1975, pp. 687–689.

Lindberg, "A Shallow–Cavity UHF Crossed–Slot Antenna". IEEE Trans. Antenna Propagat vo. AP–17, pp. 558–563, Sep. 1969.

1988 International Symposium Digest Antennas and Propagation, vol. 1, Jun. 1988, Syracuse, NY, pp. 312–315; Clouston et al.: "A Triplate Stripline Slot Antenna Developed for Time–Domain Measurements on Phased Arrays".

*Primary Examiner*—Donald T. Hajec
*Assistant Examiner*—Hoanganh Le
*Attorney, Agent, or Firm*—Sughrue, Mion, Zinn, Macpeak & Seas

[57] ABSTRACT

A miniaturized radio antenna element for use at VHF and UHF is designed to operate well short of resonance. It comprises a small flat cavity in the surface of which is formed at least one radiating slot very much smaller than a normal resonant slot. However, an impedance matching circuit is often required at the ports of this antenna.

14 Claims, 6 Drawing Sheets

MINIATURIZED RADIO ANTENNA ELEMENT

This is a continuation of application Ser. No. 07/925,181, filed Aug. 6, 1992, now abandoned.

BACKGROUND OF THE INVENTION

1. Field of the Invention

The present invention concerns a miniaturized radio antenna element for use at VHF and UHF in particular, in other words in a frequency band extending from a hundred or so Megahertz up to a few Gigahertz. An antenna of this kind may be fitted to a radio communication satellite.

2. Description of the Prior Art

The earliest VHF and UHF antennas were wire antennas. At these relatively low frequencies the antenna has large overall dimensions which represents a serious weight and overall dimensions penalty in the case of a satellite. Furthermore, precisely because of these large overall dimensions, the antennas must be stowed in a folded configuration for storage and for launching the satellite and then deployed when the satellite is in its final orbit. This requires a complex, costly, bulky and heavy deployment mechanism and there is always the risk of failure when this mechanism is operated when the satellite has reached its orbit.

It is highly advantageous to miniaturize VHF and UHF antennas as much as possible and one way that springs to mind to achieve this is to use the currently fashionable technique of "patch" type printed circuit antennas comprising a conductive square separated from a ground plane by a thin insulative substrate whose permitivity is Er. The conductive square is deposited on the substrate by a conventional printed circuit technology and in a conventional implementation the side of the square has a length of approximately:

$$\lambda/2.\sqrt{Er}$$

where $\lambda$ is the wavelength transmitted or received by the printed circuit antenna.

In air and at the frequencies of relevance in the present context the dimensions of these antennas are still much too large.

The use of a substrate with a high dielectric constant Er, such as alumina, is one way to reduce the overall dimensions, but not to a sufficient degree. Also, a high permittivity represents a significant penalty in terms of the radiation properties of the resulting antenna, to the extent that a solution of this kind is in the final analysis somewhat suspect.

There are insulators with even higher permittivity, such as sintered ceramics. At present, however, it is not feasible to use such materials in an industrial environment. What is more, the radiation performance of such antennas would be even worse.

The invention is directed to alleviating these drawbacks.

SUMMARY OF THE INVENTION

The invention consists in a miniaturized radio antenna element, suitable for use with signals at VHF and UHF comprising one or more radiating slots whose dimensions are very much less (by about an order of magnitude or factor of 10) than those of normally resonant slots for the operating frequency or frequencies of the antenna which therefore operates well short of resonance, said slot(s) being formed in one of the two larger sides of a cavity which is also very much smaller (by about an order of magnitude or factor of 10) than a resonant cavity for said operating frequency or frequencies, in which antenna each signal port is coupled to the respective signal feed line through at least one impedance matching circuit.

The invention will be better understood and its advantages and its other features will emerge from the following description given by way of non-limiting example only and with reference to the appended diagrammatic drawings of a few embodiments of a miniaturized non-resonant antenna.

DETAILED DESCRIPTION OF THE INVENTION

Figure 1:
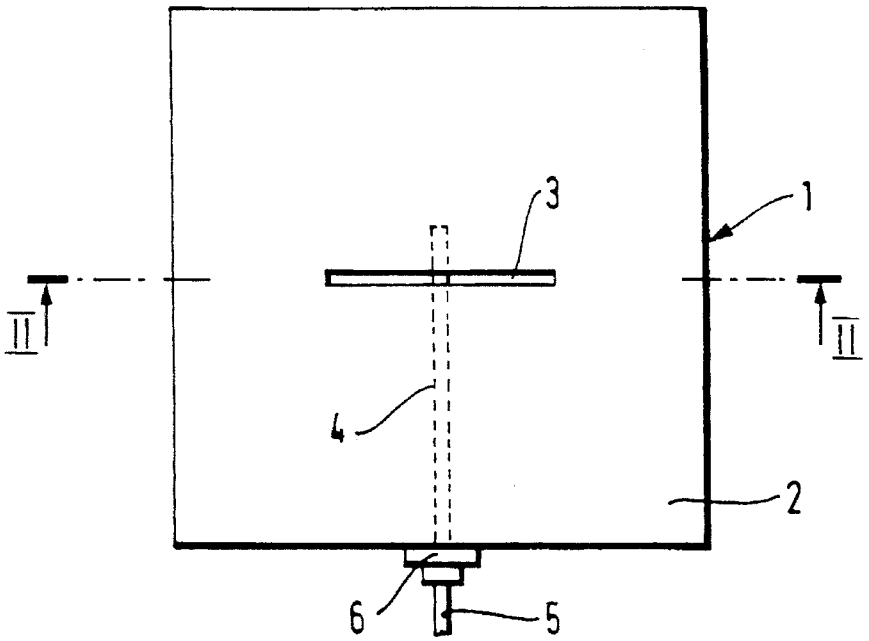
FIG. 1 is a plan view of a simple embodiment of the antenna element.
Figure 2:
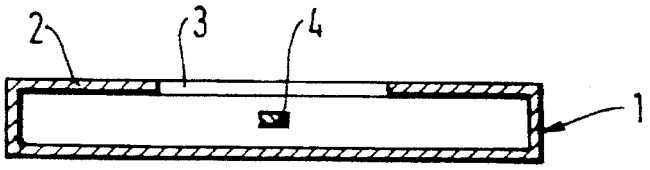
FIG. 2 shows the same radiating element in cross-section on the line II—II in FIG. 1.

Referring to FIGS. 1 and 2, the miniaturized antenna element comprises a flat cavity 1 made from aluminum and rectangular in cross-section with a side length of 10 to 15 cm and a small overall height of 5 cm to minimize the overall size; one larger side, the upper side 2 in this example, incorporates a narrow radiating slot 3 which, in accordance with the teaching of the invention, is dimensioned well short of resonance: rather than having a length equal to the half-wavelength ($\lambda/2$) its length is a much smaller fraction of the wavelength, for example around $\lambda/10$ or even $\lambda/20$, i.e., smaller by about an order of magnitude (or by a factor of about 10).

It is found that the radiating characteristics of a slot 3 of this kind coupled to this cavity, whatever the dimensions of the cavity, remain highly acceptable even though the system operates well short of resonance.

The slot 3 is excited in a conventional way, for example by a probe 4 which extends the core of a triplate transmission line 5 connected to the cavity 1 by a connector 6 at a signal port of the antenna.

Of course, unlike prior art resonant antennas this antenna is not impedance matched and according to the teaching of the invention an impedance matching circuit, which may itself be of conventional design, is provided between the antenna and the respective main feed line.

Figure 3:
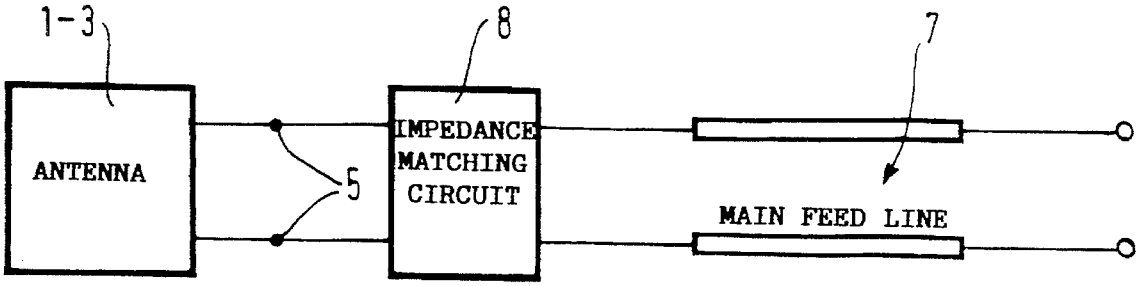
FIG. 3 is a block diagram showing how the antenna is connected.

FIG. 3 is a block diagram showing how the antenna 1, 3 is connected to its main signal feed line 7 shown as a quadripole network. An impedance matching circuit 8 is therefore provided between the antenna 1, 3 and the main line 7 to remedy the impedance mismatch of the antenna.

The slot 3 and the associated cavity 1 can have any dimensions provided that they are very much smaller than those representing the condition of resonance. Nevertheless, a plot of the radiation patterns of this antenna at various frequencies in the VHF-UHF band shows that there are frequencies for which the pattern has a trough in the axial radiation direction and a dominant lobe at about 40 to 60 degrees on either side of this.

A characteristic of this kind is particularly advantageous in the case of satellite antennas because it then coincides with the optimum radiation pattern with the result that in the final analysis it will sometimes be appropriate to choose a slot length yielding a diagram of this type for the VHF or UHF frequencies employed, in other words a pattern having a trough in the axial radiation direction defining two lateral lobes at about 40 to 60 degrees to either side.

There is no simple method of calculating the optimum dimensions which satisfy this condition, but they can easily be optimized by laboratory tests and measurements.

The device that has just been described is not the only feasible implementation, of course, and FIGS. 4 through 12 to be described now show a few variants of the antenna among many possible others.

Figure 4:
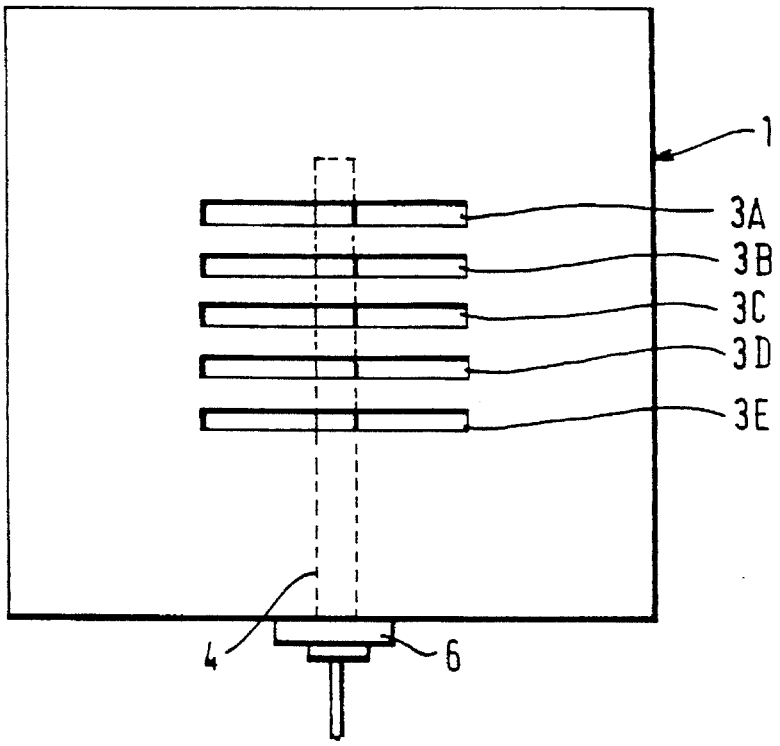
FIGS. 4, 5 and 6 show in the same way as FIG. 1 three other configurations using a plurality of parallel slots on a common cavity.

The implementation in FIG. 4 differs from that of FIG. 1 in that the single slot 3 is replaced by an array of five identical parallel slots 3A through 3E which improves the gain of the antenna and provides better control of the radiation pattern.

Figure 5:
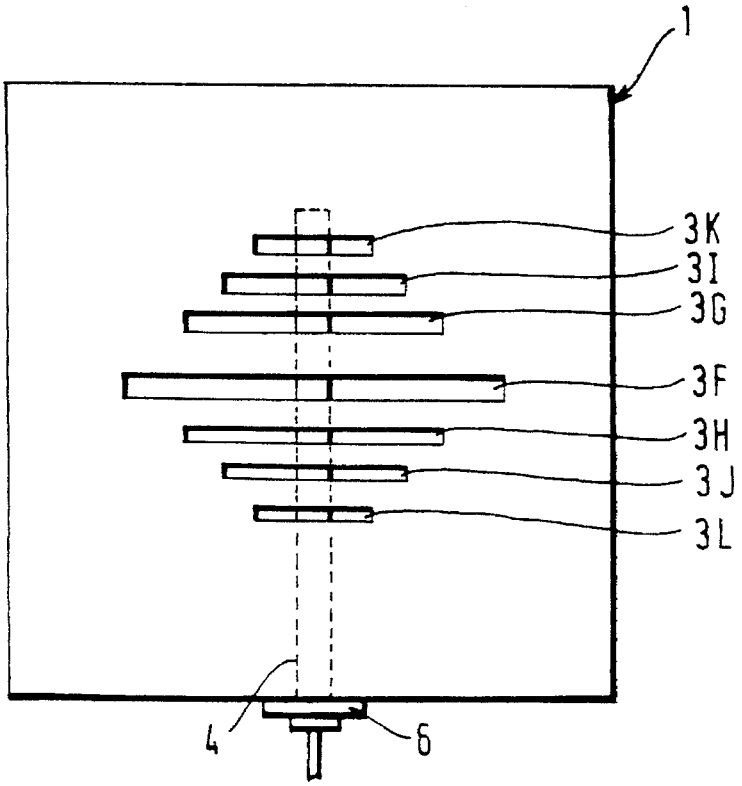

The antenna in FIG. 5 has seven parallel slots, of which a central slot 3F is the longest and the others disposed in symmetrical pairs to either side thereof constitute three pairs of slots of decreasing length in the direction away from the central slot 3F:

a first pair of identical slots 3G, 3H;

a second pair of identical slots 3I, 3J; and a third pair of identical slots 3K, 3L.

An antenna of this type can be used either to obtain a distribution law representing a specific pattern or to radiate at four specific frequencies using a single impedance matching circuit.

Figure 6:
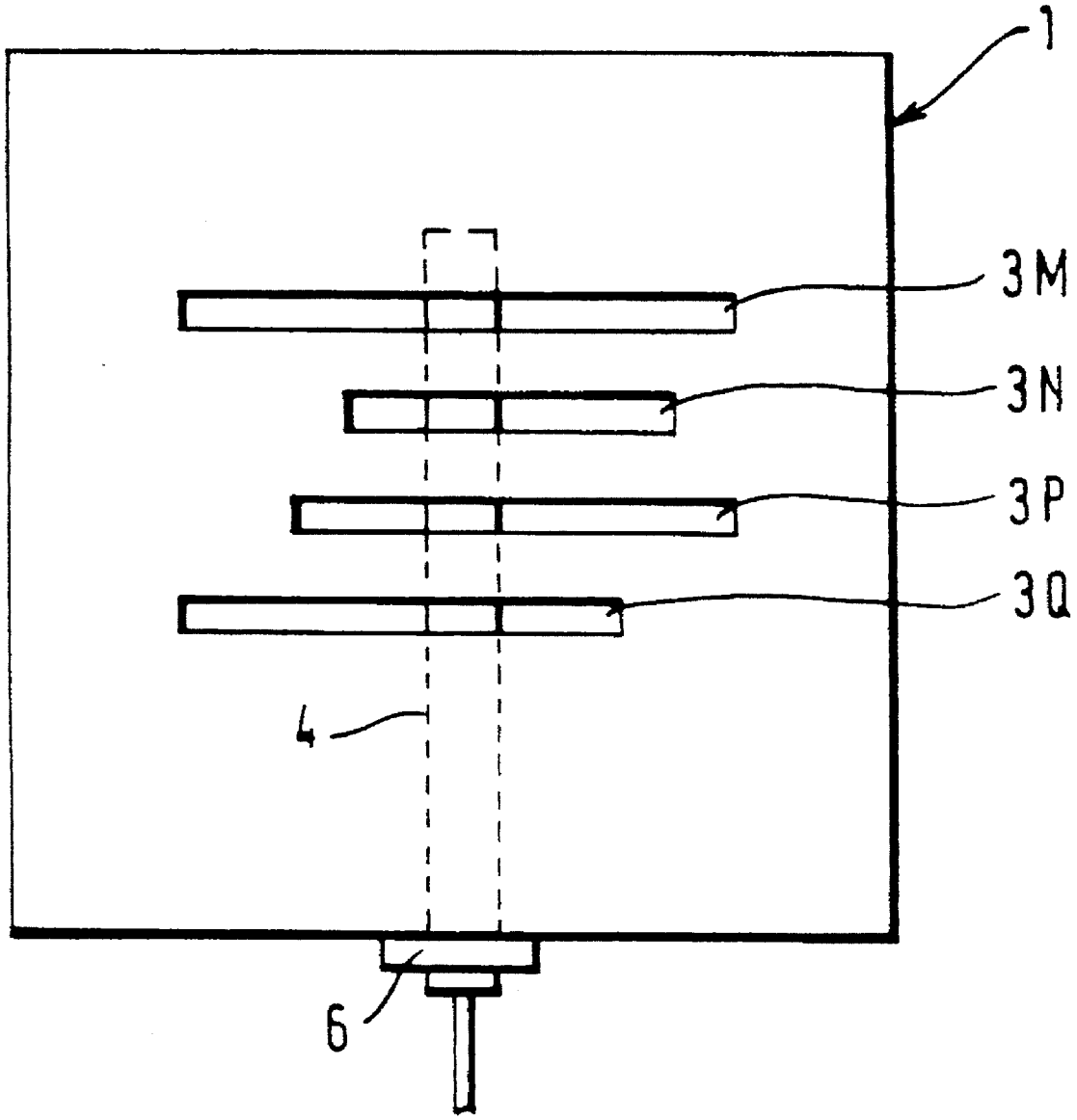

Referring to FIG. 6, a multislot antenna may comprise, for example to obtain a specific radiation pattern, a plurality of parallel slots 3M, 3N, 3P, 3Q which are offset relative to each other in the lateral direction, in other words in the direction orthogonal to the probe 4.

The antennas described until now are designed to use linear polarization. It is also possible to implement an antenna in accordance with the invention using circular polarization, as shown in FIGS. 7 through 10, for example.

Figure 7:
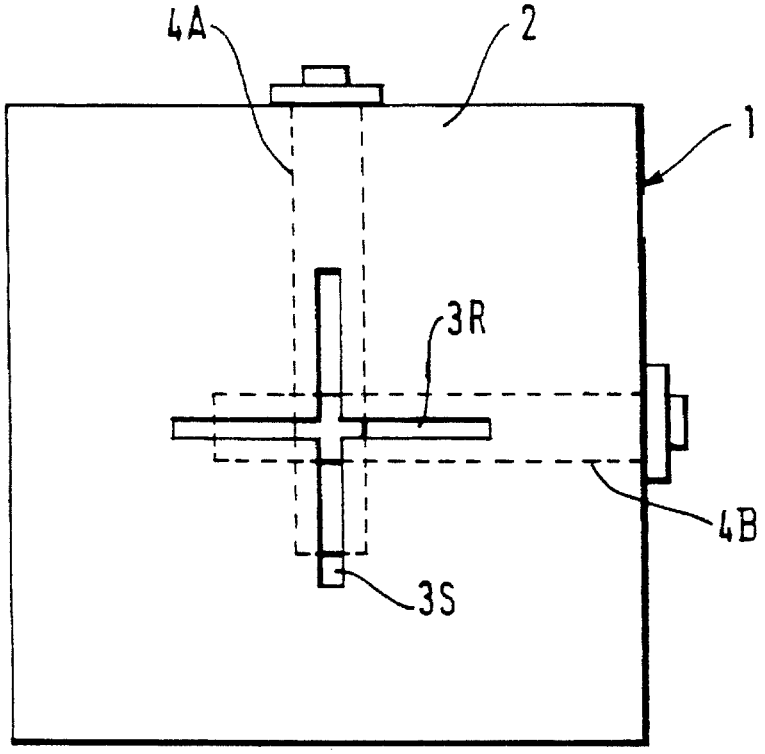
FIGS. 7 through 10 show in the same way possible implementations and methods of excitation of a radiating element comprising two orthogonal slots.

Referring to FIG. 7, the cavity is intersected by two identical orthogonal slots 3R, 3S forming a Greek cross whose center is at the center of the square surface 2.

The slot 3R is fed by a probe 4A orthogonal to it. The slot 3S is fed similarly by another probe 4B. The two probes 4A, 4B are therefore orthogonal. To achieve circular polarization using the cruciform slot 3R, 3S the two probes 4A, 4B are fed with signals at the same frequency and in phase quadrature.

Note that interference may be a problem because of the colinearity of the probe 4A and the slot 3S on the one hand and that of the probe 4B and the slot 3R on the other hand.

Figure 8:
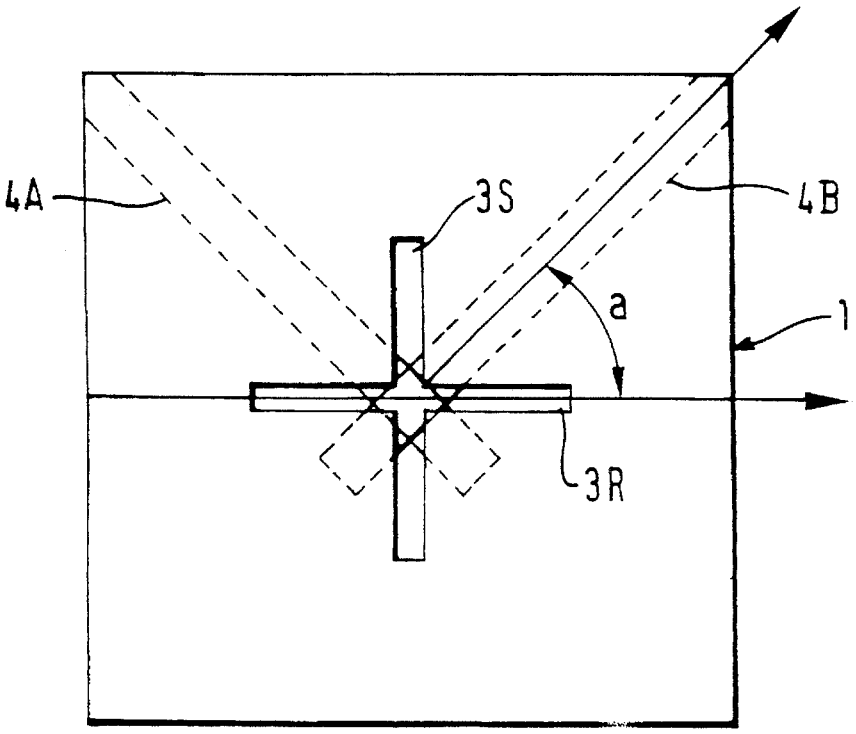

There are several variants of the FIG. 7 antenna avoiding such interference:

Referring to FIG. 8, the aforementioned probes 4A and 4B are offset by an angle a relative to the normal to the respective slot 3R and 3S that they feed. This angle a is in the order of 45 degrees, for example.

Figure 9:
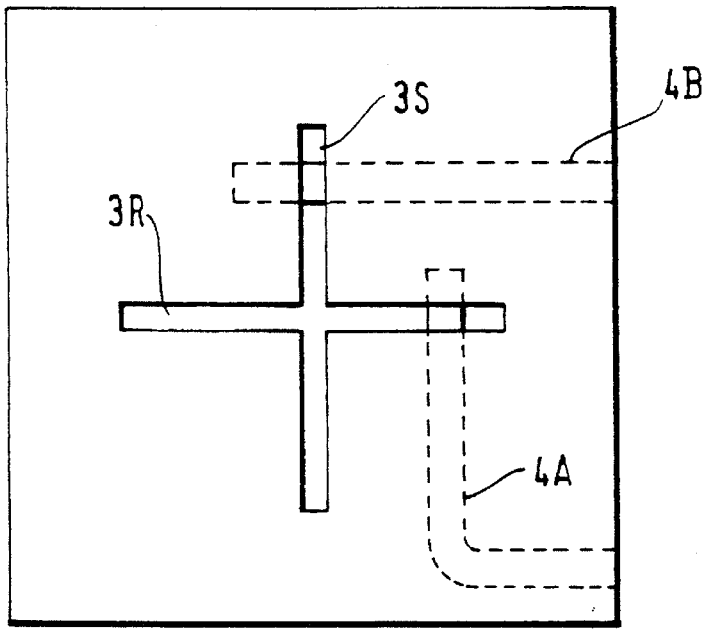

Referring to FIG. 9, the feed probes 4A and 4B are offset laterally to the middle point of the respective slot 3R and 3S which they feed and to which they are respectively orthogonal.

Figure 10:
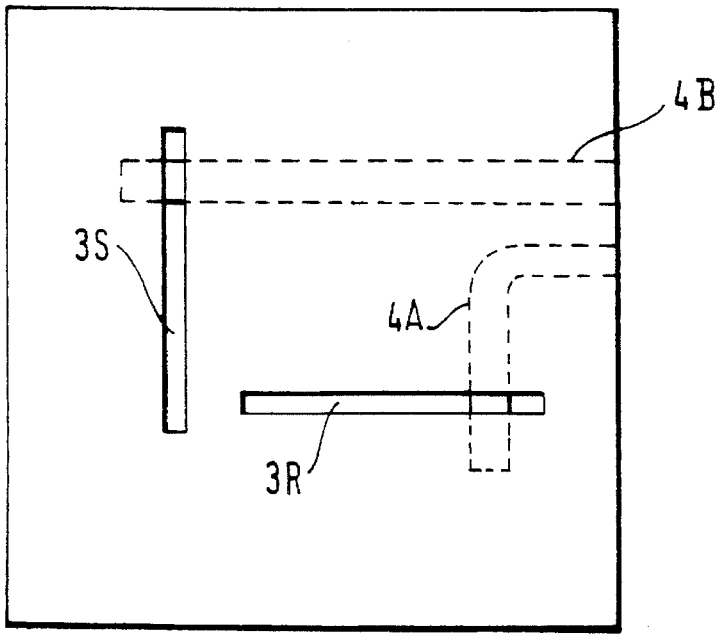

Finally, referring to FIG. 10, the optimum is achieved and all interference is avoided by the fact that, relative to FIG. 9, the slots 3R and 3S are themselves additionally offset relative to each other so that they no longer intersect, although they remain orthogonal.

Figure 11:
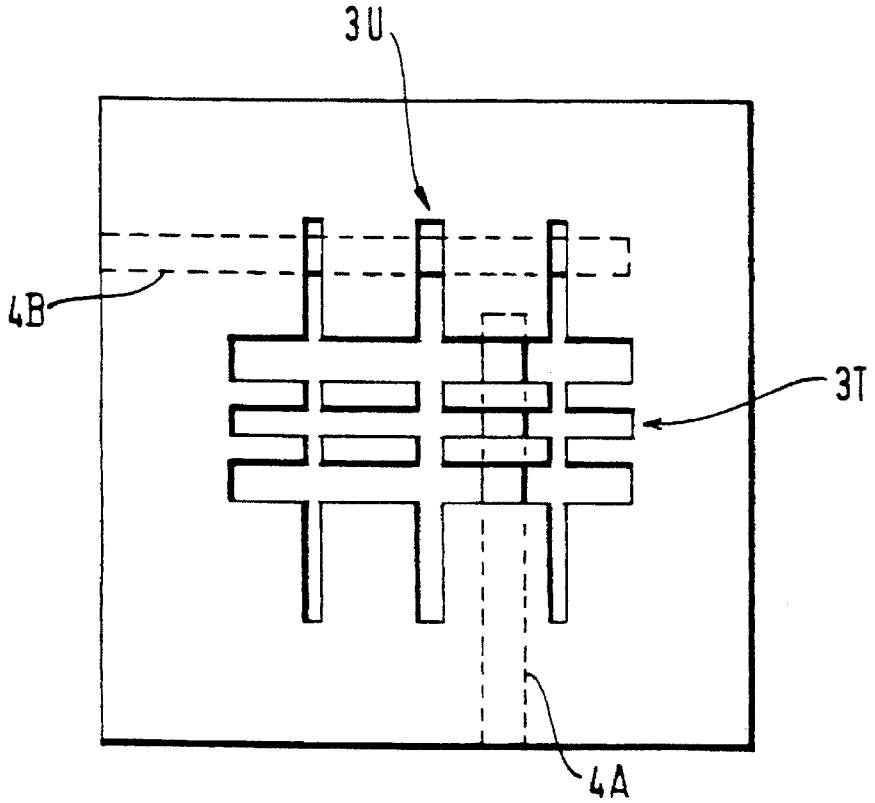
FIG. 11 similarly shows a dual-polarization configuration comprising a plurality of slots for each polarization.

FIG. 11 shows another variant of this antenna which has two orthogonal feed probes 4A, 4B each feeding an array 3T, 3U of identical parallel slots. This is a dual-polarization multislot antenna.

Figure 12:
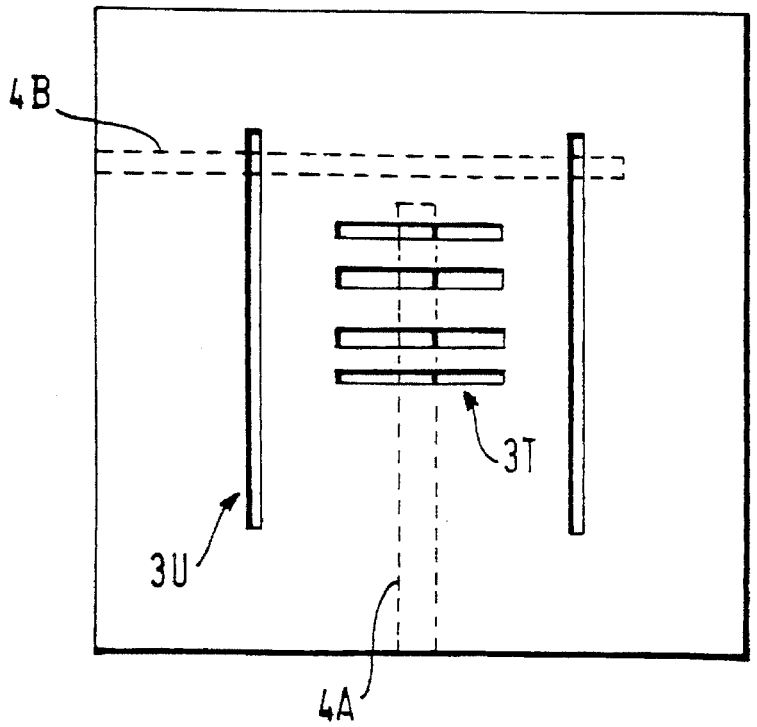
FIG. 12 shows a multislot, dual-polarization and dual-frequency configuration.

Finally, FIG. 12 shows a dual-polarization variant of this antenna with two arrays 3T, 3U of slots in which the slots of the array 3T are significantly shorter than those of the array 3U. An antenna of this kind is advantageous for radiating two very different frequencies with orthogonal polarizations.

It is self-evident that the invention is not limited to the embodiments that have just been described. For example, it is possible further to miniaturize the antenna element by filling the cavity 1 partially or totally with an insulative material such as alumina, for example. The cross-section of the cavity can of course be circular or any other shape instead of rectangular.

There is claimed:

1. A miniaturized radio slot antenna element suitable for use with signals at VHF and UHF, comprising:

at least one non-resonant radiating slot having a total length dimension in the range of approximately $\lambda/10$ to $\lambda/20$, so that the total length dimension is very much less than that of a normally resonant slot for an operating frequency of the antenna element which therefore operates well short of resonance at said operating frequency having a wavelength $\lambda$, said slot being formed in one of two larger sides of an operating cavity which is also very much smaller, by about an order of magnitude or a factor of 10, than a resonant cavity at said operating frequency; and a coupling means for coupling at least one signal port of the antenna element to a respective main signal feed line through at least one impedance matching circuit.

2. The antenna element according to claim 1 comprising a plurality of parallel radiating slots.

3. The antenna element according to claim 2 wherein said parallel slots have lengths that produce an antenna operating at a plurality of particular frequencies using a single common impedance matching circuit.

4. The antenna element according to claim 2 wherein said parallel slots are offset relative to each other.

5. The antenna element according to claim 1 adapted to radiate with circular polarization, and comprising two identical radiating slots forming a Greek cross.

6. The antenna element according to claim 5 wherein the respective main feed lines of said two slots are offset angularly relative to the normal to the slot which they respectively feed.

7. Antenna according to claim 6 wherein said angular offset is in the order of 45 degrees.

8. The antenna element according to claim 5 wherein the respective main feed lines of said two slots are offset laterally relative to a middle point of the slot that they respectively feed.

9. The antenna element according to claim 1 adapted to radiate with circular polarization, and comprising two non-secant orthogonal and identical slots.

10. The antenna element according to claim 1 adapted to operate with orthogonal polarizations, and comprising a respective array of parallel slots for each polarization.

11. The antenna element according to claim 1 wherein said operating cavity is at least partially filled with an insulative material.

12. The antenna element according to claim 1, wherein the slot has a length dimension that produces a radiation pattern having a trough in an axial radiation direction defining two lateral lobes at about 40 to 60 degrees to either side of said axial direction.

13. The antenna element according to claim 1, further comprising two antenna main feed lines, and an impedance matching circuit coupling said two antenna main feed lines to two antenna ports.

14. The antenna element according to claim 1, wherein said operating cavity has a rectangular cross section.

* * * * *